US005850626A

United States Patent [19]

Kallio

[11] Patent Number: 5,850,626

[45] Date of Patent: Dec. 15, 1998

[54] DIVER'S COMPUTER

[75] Inventor: Jorma Kallio, Helsinki, Finland

[73] Assignee: Suunto Oy, Espoo, Finland

[21] Appl. No.: 769,593

[22] Filed: Dec. 18, 1996

[30] Foreign Application Priority Data

Dec. 21, 1995 [FI] Finland ..... 956164

[51] Int. Cl.[6] ..... G06F 159/00

[52] U.S. Cl. ..... 702/139; 73/865.1; 73/291; 128/201.27; 702/50; 702/140

[58] Field of Search ..... 364/558; 73/865.1, 73/290 R, 291; 128/201.27; 702/50, 139, 140

[56] References Cited

U.S. PATENT DOCUMENTS

| | | | |
|---|---|---|---|
| 4,107,995 | 8/1978 | Ligman et al. | 73/300 |
| 5,031,160 | 7/1991 | Koizumi et al. | 73/290 R |
| 5,148,376 | 9/1992 | Sato | 364/558 |
| 5,156,055 | 10/1992 | Hollis et al. | 73/865.1 |
| 5,189,646 | 2/1993 | Sako et al. | 73/290 R |
| 5,301,668 | 4/1994 | Hales | 340/525 |
| 5,392,771 | 2/1995 | Mock et al. | 340/297 |
| 5,457,284 | 10/1995 | Ferguson | 364/558 |
| 5,570,688 | 11/1996 | Cochran et al. | 73/865.1 |
| 5,617,848 | 4/1997 | Cochran | 128/205.23 |

FOREIGN PATENT DOCUMENTS 4236175 4/1994 Germany .

*Primary Examiner*—Louis M. Arana
*Assistant Examiner*—Hein Vo
*Attorney, Agent, or Firm*—Steinberg & Raskin, P.C.

[57] ABSTRACT

A diver's computer including detectors for measurement and determination of diving parameters, a processor for processing the measured and determined data, and memory functions for storage of the measured and collected data. According to the invention, the diver's computer is provided with a detachable memory unit in which the measured and collected data have been arranged to be stored and which memory unit can be connected to a personal computer or equivalent for analyzing the data. Of the measured and collected data, preferably at least the data on the diving depth, diving time and starting time of the dive, the data on the pressure in the bottle, the situation of residual nitrogen, and possible violations by the diver are preferably stored in the detachable memory unit. The detachable memory unit is preferably user-specific in view of storage of personal data.

8 Claims, No Drawings

DIVER'S COMPUTER

FIELD OF THE INVENTION

The invention relates to a diver's computer which includes detectors for measuring and determining diving parameters and a processor for processing the measured and determined data of diving parameters, and memory functions for storage of the measured and collected data. The invention also relates to a method for analyzing data relating to diving parameters obtained by a diving computer at a site apart from the diving computer.

BACKGROUND OF THE INVENTION

Modern diver's computers are provided with highly versatile functions, and therefore they are connected with complex detector systems, because the diver must be aware of a number of parameters important for diving and, in particular, for the safety of diving. During diving operations, the diver's computer measures and collects information, for example, on the following quantities: momentary diving depth, diving time, time of direct ascent, maximal depth during diving, ceiling depth, i.e., the lowest depth to which ascent is permitted during leg diving, leg ascent time, temperature, speed of ascent, etc. On the surface, it is required from a diver's computer further that it must be capable of stating, among other things, the following quantities: interval on surface, diving time of preceding dive, current number of dive, maximal depth of the preceding dive, data on the diving plan, temperature, date and time. Further, it is advantageous if the diver's computer can state the personal time of flight prohibition, display a leg stop that was not complied with, etc.

In order that maximum use can be made of the large quantity of collected and measured information, it must be possible to analyze the collected information between dives. Therefore, several modern diver's computers are provided with a memory or with corresponding memory functions for the storage of information. This information to be stored includes, for example, diving depths, diving times, data on diving profiles, data on bottle pressure, various alarm data, etc. A study of this information has, however, as a rule, been possible only by operating the device.

Some diver's computers are provided with an interface by whose means the diver's computer can be connected to a personal computer so that, through the interface, the data can be transferred into the memory of the personal computer. The use of such an interface is, however, difficult in particular in the case of devices provided with measurement of pressure, because the diver's computer is connected with a compressed-air bottle through a hose.

OBJECTS OF THE INVENTION

It is an object of the present invention to improve and to facilitate the transfer of data between a diver's computer and a personal computer and to facilitate analyzing of the information collected during diving.

It is another object of the present invention to provide a new and improved diver's computer.

It is another object of the present invention to provide a new and improved method for analyzing data relating to diving parameters obtained by a diving computer at a site apart from the diving computer.

SUMMARY OF THE INVENTION

In view of achieving these objects and others, the diver's computer in accordance with the invention is provided with a detachable memory unit in which the measured and collected data have been arranged to be stored and which memory unit can, after detachment from the diver's computer, be connected to a personal computer or equivalent for analysis of the data.

The present invention involves a number of significant advantages over the prior art, and of these advantages, among other things, the following can be stated. Since the diver's computer in accordance with the invention is provided with a detachable memory unit, in which the collected information is stored, the data can be transferred from the diver's computer to a personal computer by detaching the memory unit from the diver's computer and attaching it to the personal computer, in which case, the diving equipment does not have to be disassembled for analyzing of the data. The memory unit can be detached readily from the diver's computer and attached to same, and, as to its type, it can be, for example, a memory card similar to those used in the present-day portable GSM telephones.

In addition to the information concerning the diving profile and equivalent, in the memory unit it is possible store user-specific data, data on the situation, and equivalent, such as, for example, a setting of the user-specific risk and the current situation of residual nitrogen and the time and the date. Then, the same diver's computer can be used jointly by several persons because, when the user is changed, just the user's personal memory unit has to be changed in the diver's computer.

DESCRIPTION OF THE PREFERRED EMBODIMENTS

In a most basic embodiment of the diver's computer in accordance with the invention, the computer comprises detector means for measuring and determining diving parameters, processor means coupled to the detector means for receiving the measured and determined diving parameters and processing the measured and determined diving parameters, and memory means coupled to the processor means for receiving the measured and determined diving parameters and storing the diving parameters. Most importantly, the memory means are structured and arranged to be detachable from the diver's computer, i.e., temporarily decoupled from the processor means (the processor means and memory means being coupled for information/data transfer by means of any conventional information/data transfer apparatus or component), and connectable to a personal computer for analysis of the measured and determined diving parameters. The detector means are structured and arranged to measure and determine at least data on the diving depth, diving time and starting time of a dive, the pressure in a bottle used for the dive, the situation of residual nitrogen, and possible violations by the diver whereby the detachable memory means are structured and arranged to store the data on the diving depth, the diving time and the starting time of a dive, the pressure in the bottle used for the dive, the situation of residual nitrogen, and possible violations by the diver. The detachable memory means may be a memory unit or a memory card which is user-specific and stores a particular user's personal data including but not limited to a personal setting state, current amount of residual nitrogen, time and date.

The method for analyzing data relating to diving parameters obtained by a diving computer at a site apart from the diving computer comprises the steps of measuring and determining diving parameters during at least one dive, processing the measured and determined diving parameters from the at least one dive in a processing unit, storing the measured and determined diving parameters before and/or after processing in a memory unit removably connected to the processing unit, detaching the memory unit from the processing unit after the memory unit has sorted the measured and determined diving parameters, and connecting the detached memory unit to a personal computer for analysis of the measured and determined diving parameters. The step of measuring and determining diving parameters may comprise the step of measuring and determining data on the diving depth, diving time and starting time of a dive, the pressure in a bottle used for the dive, the situation of residual nitrogen, and possible violations by the diver. To make the memory unit user-specific, the method may include the step of storing a particular user's personal data therein including but not limited to a personal setting state, current amount of residual nitrogen, time and date.

Above, the invention has been described fully by way of example. The description is, however, exclusively meant to illustrate the invention without in any way strictly restricting the invention. Thus, different alternative embodiments of the invention can show variation within the scope of the inventive idea defined in the accompanying claims.

I claim:

1. In a diver's computer having detector means for measuring and determining diving parameters, processor means coupled to said detector means for receiving the measured and determined diving parameters and processing the measured and determined diving parameters, and memory means coupled to said processor means for receiving the measured and determined diving parameters and storing the measured and determined diving parameters, the improvement comprising said memory means being structured and arranged to be removably coupled to said processor means such that when removed from connection to said processor means, said memory means are connectable to a personal computer for analysis of the measured and determined diving parameters by the personal computer.

2. The diver's computer of claim 1, wherein said detector means are structured and arranged to measure and determine at least data on the diving depth, diving time and starting time of a dive, the pressure in a bottle used for the dive, the situation of residual nitrogen, and possible violations by the diver, said detachable memory means being structured and arranged to store the data on the diving depth, the diving time and the starting time of a dive, the pressure in the bottle used for the dive, the situation of residual nitrogen, and possible violations by the diver.

3. The diver's computer of claim 1, wherein said detachable memory means is a memory unit which is user-specific, said memory unit storing a particular user's personal data including but not limited to a personal setting state, current amount of residual nitrogen, time and date.

4. The diver's computer of claim 1, wherein said detachable memory means comprise a memory card.

5. A method for analyzing data relating to diving parameters obtained by a diving computer at a site apart from the diving computer, comprising the steps of:

measuring and determining diving parameters during at least one dive, processing the measured and determined diving parameters from the at least one dive in a processing unit, storing the measured and determined diving parameters before and/or after processing in a memory unit removably connected to said processing unit, detaching said memory unit from said processing unit after said memory unit has stored the measured and determined diving parameters, and connecting said detached memory unit to a computer for analysis of the measured and determined diving parameters by the computer.

6. The method of claim 5, wherein the step of measuring and determining diving parameters comprises the step of measuring and determining data on the diving depth, diving time and starting time of a dive, the pressure in a bottle used for the dive, the situation of residual nitrogen, and possible violations by the diver.

7. The method of claim 5, further comprising the step of storing a particular user's personal data in said memory unit including but not limited to a personal setting state, current amount of residual nitrogen, time and date.

8. The method of claim 5, wherein said memory unit is a memory card.

* * * * *